United States Patent [19]

Lesser

[11] Patent Number: 5,012,061

[45] Date of Patent: Apr. 30, 1991

[54] MICROWAVE SAFETY LID

[76] Inventor: Emmett H. Lesser, 17255 N. Creek La., Farmington, Minn. 55024

[21] Appl. No.: 549,949

[22] Filed: Jul. 9, 1990

[51] Int. Cl.[5] ..... H05B 6/80

[52] U.S. Cl. ..... 219/10.55 E; 426/118; 426/234; 99/DIG. 14; 220/367

[58] Field of Search ..... 219/10.55 E, 10.55 F, 219/10.55 R; 426/107, 118, 113, 114, 234, 243; 99/DIG. 14; 220/367, 373

[56] References Cited

U.S. PATENT DOCUMENTS

| | | | |
|---|---|---|---|
| 4,027,132 | 5/1977 | Levinson | 219/10.55 F |
| 4,158,760 | 6/1979 | Bowen et al. | 219/10.55 E |
| 4,166,208 | 8/1979 | Martel et al. | 219/10.55 E |
| 4,486,640 | 12/1984 | Bowen et al. | 219/10.55 E |
| 4,560,850 | 12/1985 | Levendusky et al. | 219/10.55 E |
| 4,640,838 | 2/1987 | Isakson et al. | 426/107 |
| 4,703,149 | 10/1987 | Sugisawa et al. | 219/10.55 E |
| 4,745,249 | 5/1988 | Daniels | 219/10.55 E |
| 4,796,776 | 1/1989 | Dalquist et al. | 220/203 |
| 4,798,937 | 1/1989 | Guerrero | 219/433 |
| 4,801,773 | 1/1989 | Hanlon | 219/10.55 E |
| 4,814,568 | 3/1989 | Keefer | 219/10.55 E |
| 4,847,459 | 7/1989 | Desai | 219/10.55 E |
| 4,859,822 | 8/1989 | Ragusa et al. | 219/10.55 E |
| 4,873,406 | 10/1989 | Connor | 219/10.55 E |
| 4,877,624 | 10/1989 | Floyd et al. | 219/10.55 R |
| 4,896,009 | 1/1990 | Pawlowski | 219/10.55 F |
| 4,924,048 | 5/1990 | Bunce et al. | 219/10.55 E |

*Primary Examiner*—Philip H. Leung

*Attorney, Agent, or Firm*—Haugen and Nikolai

[57] ABSTRACT

An universal gas permeable, vapor releasing cover for adapting cooking vessels for use in a microwave oven includes a patterned array of openings to permit venting of vapors and gases in a relatively flat microwave permeable cover designed to accommodate varying sized vessels of the general shape described by the lid. A set of such covers can serve all popular shapes of such vessels. The holes may be tapered to reduce clogging.

4 Claims, 3 Drawing Sheets

11
12
12
13
10
14

12
20
22
7
7
21
12

MICROWAVE SAFETY LID

BACKGROUND OF THE INVENTION

I. Field of the Invention

The present invention is directed generally to covers or lids for microwave cooking vessels and, more particularly, an universal microwave permeable cover designed to accommodate varying sized open-top vessels and which is provided with an array of openings designed to uniformly vent gases and vapors built up when food is heated in the vessel.

II. Description of the Related Art

The number of microwave ovens in use by the general public has grown at a very high rate. The speed, ease and convenience of preparing foods in microwave ovens has created an increased demand for foods designed specifically to be cooked in microwave ovens and, in addition, for specialty cooking vessels designed to be used to prepare foods in microwave ovens. In general, cooking vessels specifically designed and configured for use in microwave ovens tend to be rather expensive and specialized or limited with respect to use. Such devices include, for example, microwave popcorn poppers illustrated and described in U.S. Pat. No. 4 873 406 to Connor, pressure cookers for microwave ovens, illustrated in U.S. Pat. No. 4 796 777 to Dalquist, et al. and other such containers as are illustrated in Sugisawa, et al., 4 703 149. Many microwave heating packages have been designed with a variety of vent holes and Daniels, 4 745 249, Levendusky, et al., 4 560 850, and Pawlowski, 4 896 009, are illustrative of vessels and packages of a given size which may have one or more vapor permeable vent openings designed for the escape of vapors, the permeation of microwaves, or the like.

While all of these uniquely designed cooking vessels have advanced the art of microwave cooking and provide a convenience to the user, each individual device is typically comparatively expensive; and in order to have a relatively complete set of microwave cooking vessels to meet a variety of cooking needs, the consumer has to invest a significant amount of money to obtain an array of vessel types, each being of relatively limited versatility. Accordingly, most consumers simply utilize open-topped vessels such as casserole dishes, various types of bowls and the like which are compatible with use in microwave ovens and already in their possession to accomplish most microwave cooking and heating. Often transparent polymer film coverings are placed or wrapped over the vessels to provide an inexpensive top seal to retain moisture. However, upon removal of the polymer film, a great deal of steam is often expelled in the user's face and this may lead to steam burns or may even result in the user dropping the dish he has just removed from the microwave oven. Moreover, such coverings can be used but once. The alternative is to leave the dish uncovered, but this leads to undesirable dehydration of the contents and possibly the loss of food into the oven from the container due to steam expansion upon heating by microwaves. If one attempts to provide vent holes in the film, the film often tears and thereby frustrates these efforts.

SUMMARY OF THE INVENTION

In accordance with the present invention, an inexpensive, universal vapor releasing, gas permeable cover for microwave cooking vessels or utensils is provided which includes a plurality of openings to provide for the venting of vapors and gases provided in a relatively flat microwave-permeable cover which is designed to accommodate varying sized vessels of the general peripheral shape of the cover. A plurality of such covers can serve to provide covers and venting for all popular shapes of cooking vessels. The covers of the invention can be used with any open top vessel compatible with microwave heating. The openings are preferably patterned so that the escape of steam and vapors occurs from all areas of the vessel so that uniformity in cooking is enhanced and the likelihood of hot spots decreased.

In the preferred embodiment, an array of patterned holes is present in the cover in a pattern which is somewhat more concentrated at the center and spread apart at the extremes of each cover shape. Illustrated shapes include round, square, oval and rectangular configurations. The cross-section of the top is relatively thin and preferably provided with integral side handles for easy liftoff and manipulation.

The openings themselves are preferably of a larger diameter at the outer surfaces than at the interior of the cross-section of the lid member in a manner which describes back-to-back frusto-conical shapes. The minimum diameter of the openings may be made quite small and still accomplish the desired pressure release. The frusto-conical shapes have been found to be less apt to clog and much easier to clean when the member is put in a dishwasher, or the like. The size of the lid may be made to fit the largest of several vessels of common general shape such that any size up to and including the largest may be readily accommodated by a single lid.

The cover or lid is designed to be simply placed over the vessel while in the oven and can be raised at any time to inspect the state of the contents of the vessel. Of course, the lid may also be of a visually transparent material. Any moldable or workable microwave permeable material can be used. The lids are preferably molded of any one of several common microwave permeable materials and the pattern of holes either integrally molded in the form or machined in later.

In any event, the universal microwave lid system of the present invention makes available a very inexpensive safety lid adaptable for use with microwave cooking vessels of various sizes and shapes. The handles on the lids of the preferred embodiment facilitate removal of the lid in a safe manner either inside the microwave oven for inspecting the status of the cooking process or after removal of the vessel from the microwave. When the lid is opened by tipping the far end toward the user, escaping steam is easily and safely diverted.

THE DETAILED DESCRIPTION

The preferred embodiments of the invention will next be described with reference to the several drawing figures which are intended to be representative of a preferred application of the invention but by no means limiting as to its scope or usefulness. With this in mind, the several views of the drawings will next be addressed.

Figure 1:
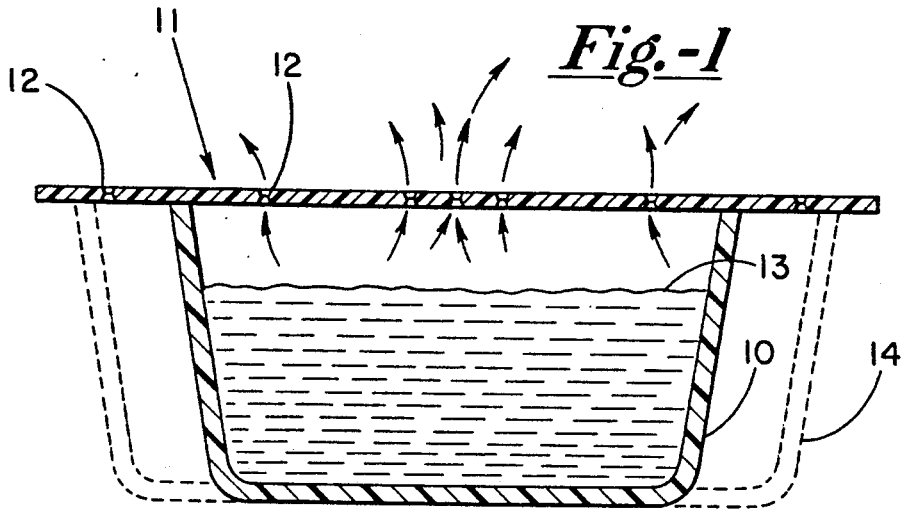
FIG. 1 is a side elevational cross-sectional view of a vessel carrying a lid in accordance with the invention including an additional, larger sized container shown in phantom.
Figure 2:
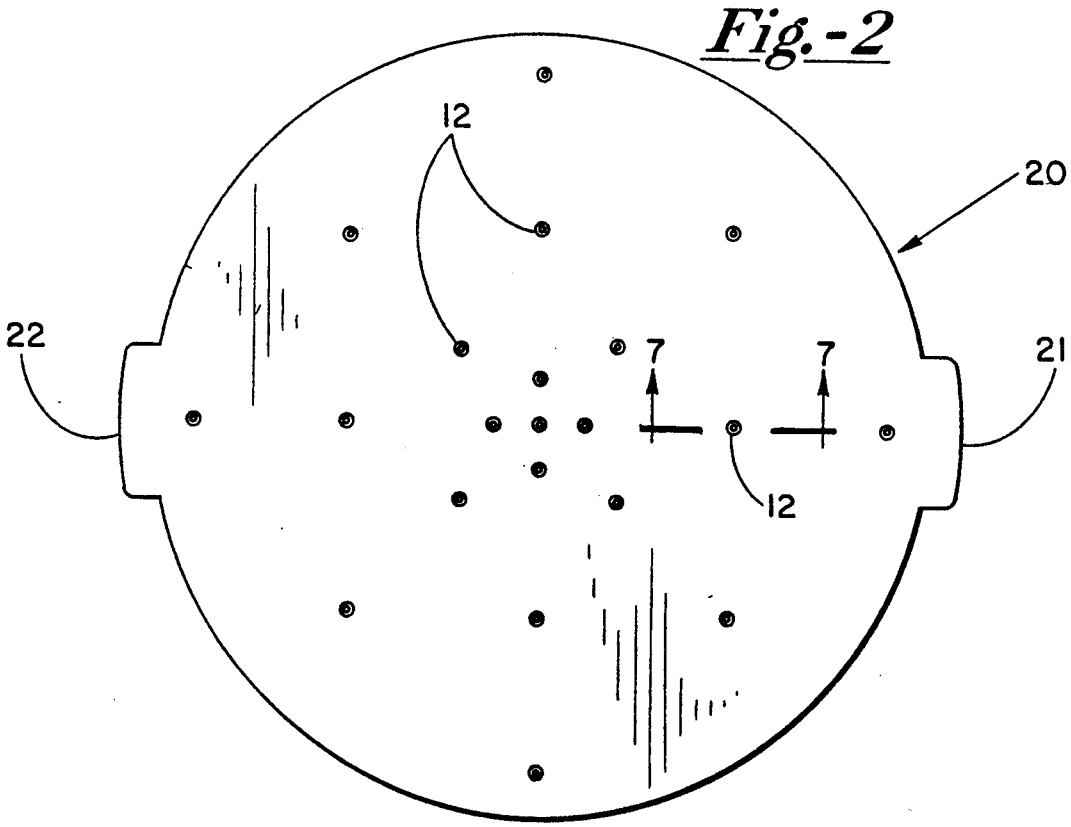
FIGS. 2–5 are top views of several typical embodiment shapes of the universal microwave safety lid of the invention.
Figure 3:
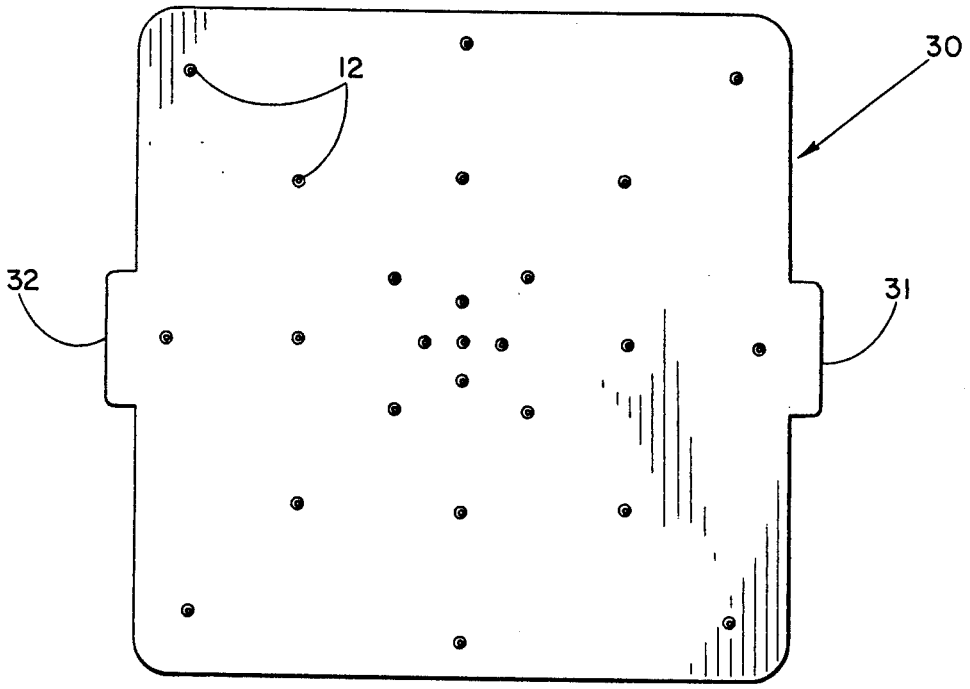
Figure 4:
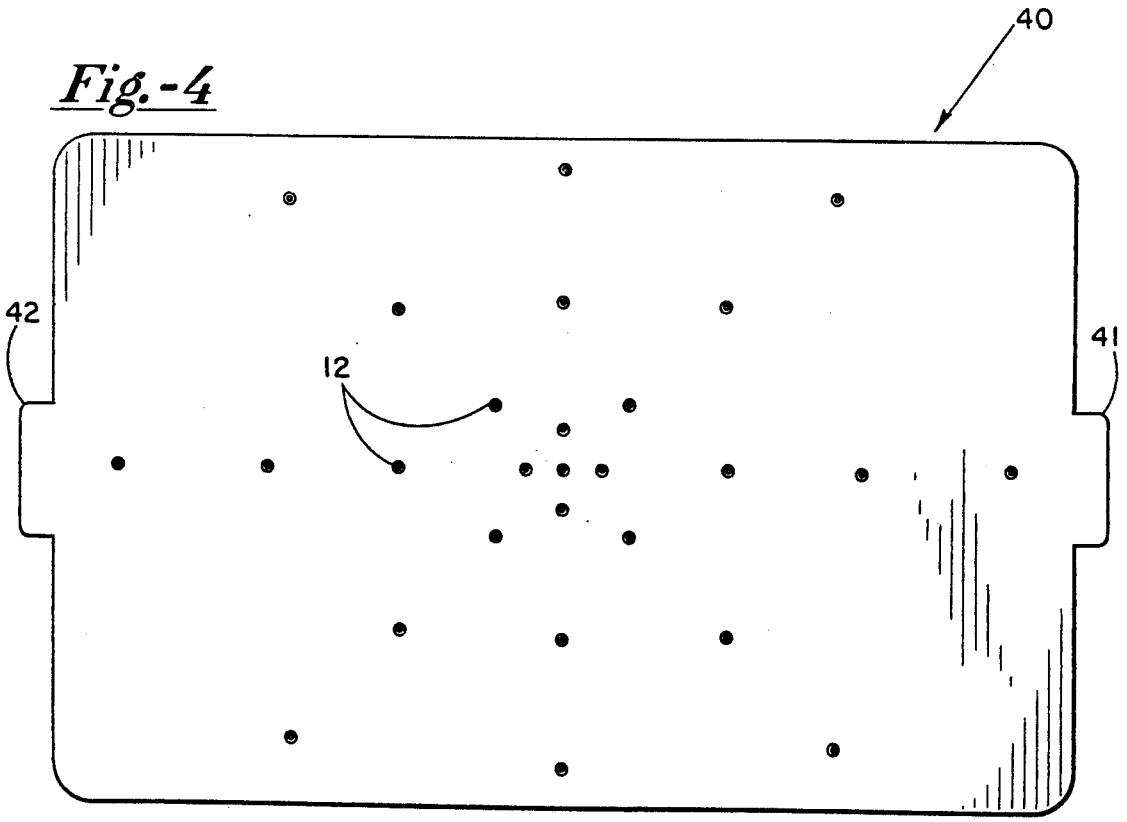
Figure 5:
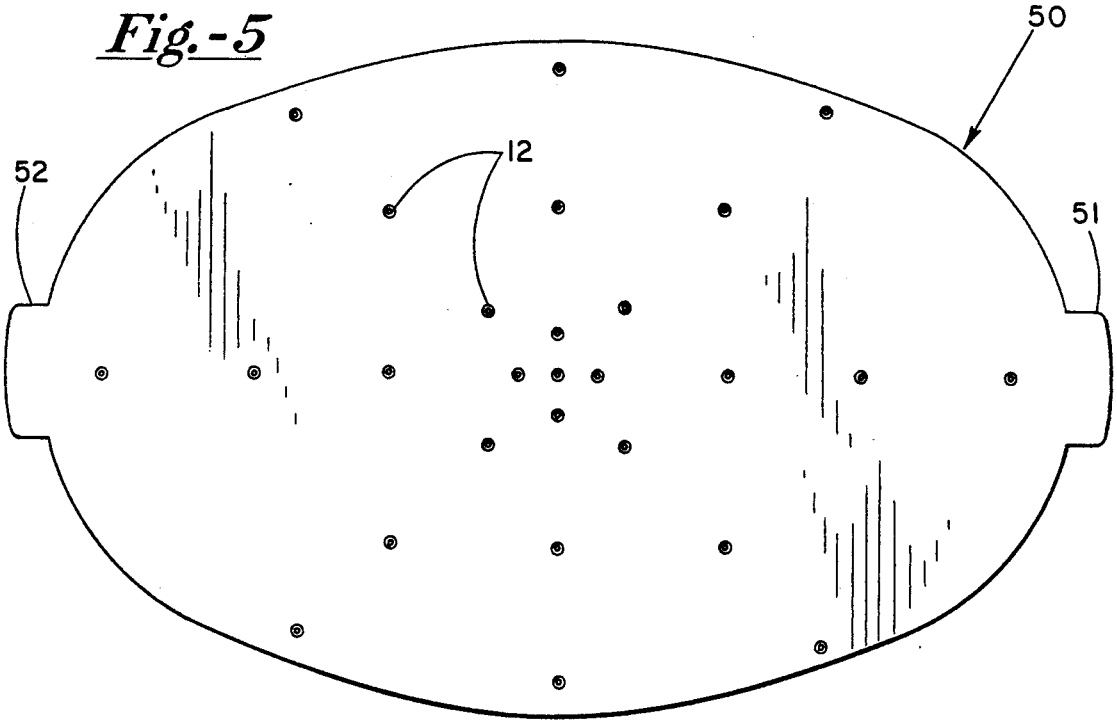

FIG. 1 illustrates an elevational, sectional view of a typical cooking vessel 10 of the type which is compatible with use in a microwave oven and on which a cover or lid 11 has been placed. The lid 11 is provided with a plurality of gas-permeable, vapor releasing openings 12. The vessel is illustrated as being partially filled with contents which may be liquid as at 13. A larger size vessel on which the same lid may be operably placed to show in phantom at 14. Integral handles in the form of tabs 15 and 16 extend beyond the edge of the vessel 14.

FIGS. 2–5 illustrate top or plan views of several typical shapes which are designed to accommodate the most common cooking vessels. These include a round lid 20, a square lid 30, a rectangular lid 40 and an oval lid 50. Each of the illustrated embodiments is provided with a pair of extended handles which are designed to extend beyond the edges of the largest vessel for which the lids are suitable. These are respectively illustrated by 21 and 22, 31 and 32, 41 and 42, and 51 and 52, respectively. These are typically molded as an integral part of the lid which is preferably of a microwave permeable, moldable plastic material and can be any one of such materials known to those skilled in the art.

Figure 6:
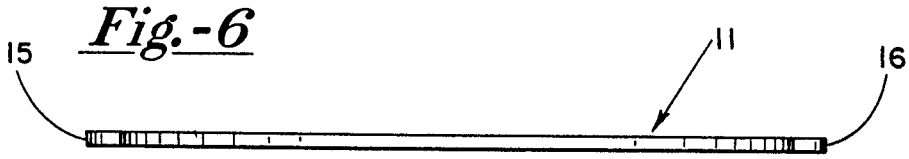
FIG. 6 is an enlarged fragmentary view showing one of the openings and taken along lines 6—6 of FIG. 2.

The holes 12 are typically patterned such that the safety lid can accommodate similarly shaped cooking vessels of various sizes and the patterned holes are designed to vent steam and vapors from various parts of different sized vessels in a manner which promotes common internal vapor conditions throughout the vessel which tends to reduce certain local hot spots typical in microwave heating. FIG. 6 shows a side elevational view of a typical lid in accordance with the invention and which is generally planar so that it may accommodate the varying sized vessels interchangeably.

Figure 7:
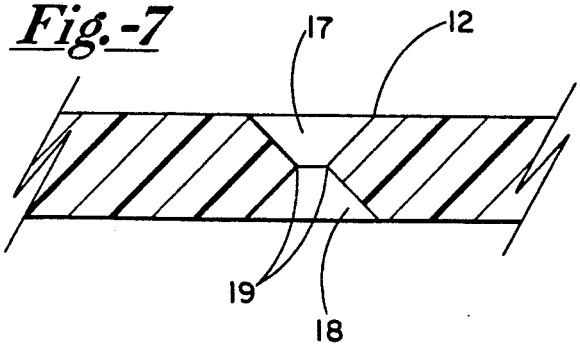
FIG. 7 is a side elevational view of the embodiment of FIG. 2.

The greatly enlarged, fragmentary sectional view of FIG. 7 illustrates the preferred geometry of the vapor permeable holes in accordance with the invention. The openings themselves are preferably of a larger diameter at the surface 16 than at the interior 17 and they are illustrated as back-to-back frusto-conical shapes 17 and 18. The minimum diameter of the openings at 19 may be made quite small and still accomplish the desired pressure release. It has been found, however, that by increasing the diameter of the holes from the center to the surface part of the substantially planar lid, the openings clog far less often and are much easier to clean with respect to any material that does lodge in one or more of the openings. The size and thickness of the lids in accordance with the invention, of course, may vary with respect to the particular application as may be the exact size of the openings 12 without deviating from the concept of the invention.

A further aspect of the present invention lies in the simplicity of accomplishing the vapor retention and the safety of pressure release in accordance with the simplified lid of the invention. The pattern of holes allows a uniform amount of vapor to exist over the food being cooked and this reduces the loss of moisture from the food. At the same time, however, the pressure is adequately vented and, the handles of the lid present an easy method for one to remove the lid in a manner which shields the user from the release of additional vapors occasioned with lid removal.

It is also readily discernable that the universal microwave safety lid of the present invention is extremely simple in construction and can be made available to microwave users at a minimum cost. Each lid is suitable for a variety of vessel sizes of similar shape and can be used for many months.

The present invention has been described herein in considerable detail in order to comply with the Patent Statutes and to provide those skilled in the art with the information needed to apply the novel principles and to construct and use the lids in accordance with the teachings. However, it is to be understood that the invention can be carried out with respect to different equipment and devices and that various modifications as to details can be accomplished without departing from the scope of the invention itself.

What is claimed is:

1. A universal microwave-permeable safety lid for use with an open top microwave heating vessel comprising:

a substantially planar microwave permeable member which when placed on the open top of a microwave heating vessel forms a barrier except for a plurality of relatively small gas and vapor permeable openings therethrough which allow the vessel to retain an amount of heated vapors and gases within the lid at ambient pressure and to provide for the venting of vapors and gases, above ambient pressure;

wherein the lid is in a shape describing a corresponding vessel geometry and the openings are in a pattern which distributes the venting over the cover area;

wherein the lid is of a size large enough to accommodate a plurality of sizes of open vessels substantially of the geometry described by the lid, the opening pattern further being configured to accommodate the distributive venting of vessels of several sizes;

the lid being further provided with at least one integral handle configured to extend beyond the sidewall of the vessel; and wherein the plurality of openings are configured in the shape of back-to-back frusto-conical sections, such that they are easily cleansed, the minimum diameter occurring central to the thickness of the lid.

2. The safety lid of claim 1 further characterized by a pair of oppositely disposed handles integral with the lid and extending beyond the basic geometric shape of the lid.

3. A safety microwave cooking system comprising:

an open-topped substantially hollow microwave compatible cooking vessel;

a substantially planar microwave-permeable safety lid of a generally similar geometric shape to that of the top of the cooking vessel, adapted to be placed atop the cooking vessel and having at least one handle extending beyond the wall of the vessel;

whereas the safety lid is characterized by a patterned array of tiny gas and vapor permeable vent openings therethrough to allow the passage of steam and other gases and vapors to allow equilibrium to be maintained between the pressure inside and outside the cooking vessel yet allow an amount of the steam and other gases and vapors to be retained contacting the cooking the material within the cooking vessel, the holes being arranged in conjunction with the total area of the lid to distribute the venting over the area of the lid and to allow the lid to accommodate a variety of sizes of similar cooking vessels therebeneath, the lid overlap varying with the size of the vessel top; and wherein the openings in the lid are further characterized by being configured in the shape of back-to-back frusto-conical sections such that the minimum diameter occurs central to the thickness of the lid.

4. The safety microwave system of claim 3 further characterized by a pair of oppositely disposed handles integral with the lid and extending beyond the basic geometric shape of the lid.

* * * * *